US005524750A

United States Patent [19]

Miller

[11] Patent Number: 5,524,750

[45] Date of Patent: Jun. 11, 1996

[54] CARD HOLDER FOR CONTAINER

[75] Inventor: Daniel R. Miller, Cincinnati, Ohio

[73] Assignee: Buckhorn Material Handling Group, Inc., Milford, Ohio

[21] Appl. No.: 511,231

[22] Filed: Aug. 4, 1995

[51] Int. Cl.[6] ..... B65D 85/00

[52] U.S. Cl. ..... 206/767; 206/449; 206/806

[58] Field of Search ..... 206/45.15, 45.31, 206/45.33, 45.34, 449, 555, 806

[56] References Cited

U.S. PATENT DOCUMENTS

| | | | |
|---|---|---|---|
| 752,018 | 2/1904 | Stewart . | |
| 1,790,451 | 1/1931 | Wagner . | |
| 1,801,078 | 4/1931 | Griffin . | |
| 2,634,020 | 4/1953 | Bartholomew . | |
| 3,225,477 | 12/1965 | Edwards . | |
| 3,671,004 | 6/1972 | Cram . | |
| 4,362,244 | 12/1982 | Cornou . | |
| 4,391,375 | 7/1983 | Joyce . | |
| 4,700,840 | 10/1987 | Haddock | 206/449 |
| 4,744,162 | 5/1988 | Okazaki . | |
| 4,884,691 | 12/1989 | Behrens et al. | 206/308.3 |
| 5,052,557 | 10/1991 | Cortino et al. | 206/45.34 X |
| 5,344,015 | 9/1994 | Carlin et al. | 206/449 |
| 5,449,066 | 9/1995 | Caine | 206/308.3 X |

FOREIGN PATENT DOCUMENTS

| | | |
|---|---|---|
| 2556117 | 6/1985 | France . |
| 83/00006 | 7/1983 | WIPO . |

*Primary Examiner*—Jacob K. Ackun

*Attorney, Agent, or Firm*—Fay, Sharpe, Beall, Fagan, Minnich & McKee

[57] ABSTRACT

An article holder that is easily attached to and removed from a display support surface that permits the display of flat articles.

13 Claims, 5 Drawing Sheets

CARD HOLDER FOR CONTAINER

FIELD OF THE INVENTION

The invention relates to a flat article holder that is detachably mounted to a surface from which the article is to be displayed.

BACKGROUND OF THE INVENTION

Holders for flat articles are used in the display of such articles for various purposes. Examples of such flat articles are information cards or papers used for the display of graphical or pictorial information. For example, in the material handling industry, cards are displayed for identifying the contents of shipping containers, such as bulk boxes, tote boxes and the like. Such cards are also used in the display of merchandise for identifying the stock number, product number and price, for example, of the merchandise. Further, in the presentation of text, graphical or pictorial data, article card holders are used for the temporary or removable display of the articles, such as cards or other flat stock articles.

In particular, flat article holders are used to display the article by removably or detachably securing the holder to a surface from which the article is to be displayed. For example, in the material handling industry, the holder is secured to a surface of a container, such as the end or side of the container. Further, the holder can be secured to the end of a conveyor or rack facing an operator, a shelf on which goods are shelved or a display that presents information relating to goods or containers that are part of the display. Generally, in each of these instances, the flat article holder is separate from the item to which the holder is attached. Further, the holder is removably attachable to the item so that it can be easily replaced when required. To facilitate the attachment of the holder to the item, and also to ensure that it is easily removable therefrom, several article holder designs have been proposed. Of these, none provides a simple and efficient manner of attaching the article holder to the associated display surface while permitting removal therefrom and subsequent reuse, as desired.

SUMMARY OF THE INVENTION

It is an object of the invention to provide an article holder that is easily attached to and removed from a display support surface that permits the display of flat articles.

DETAILED DESCRIPTION OF THE PREFERRED EMBODIMENTS

Figure 1:
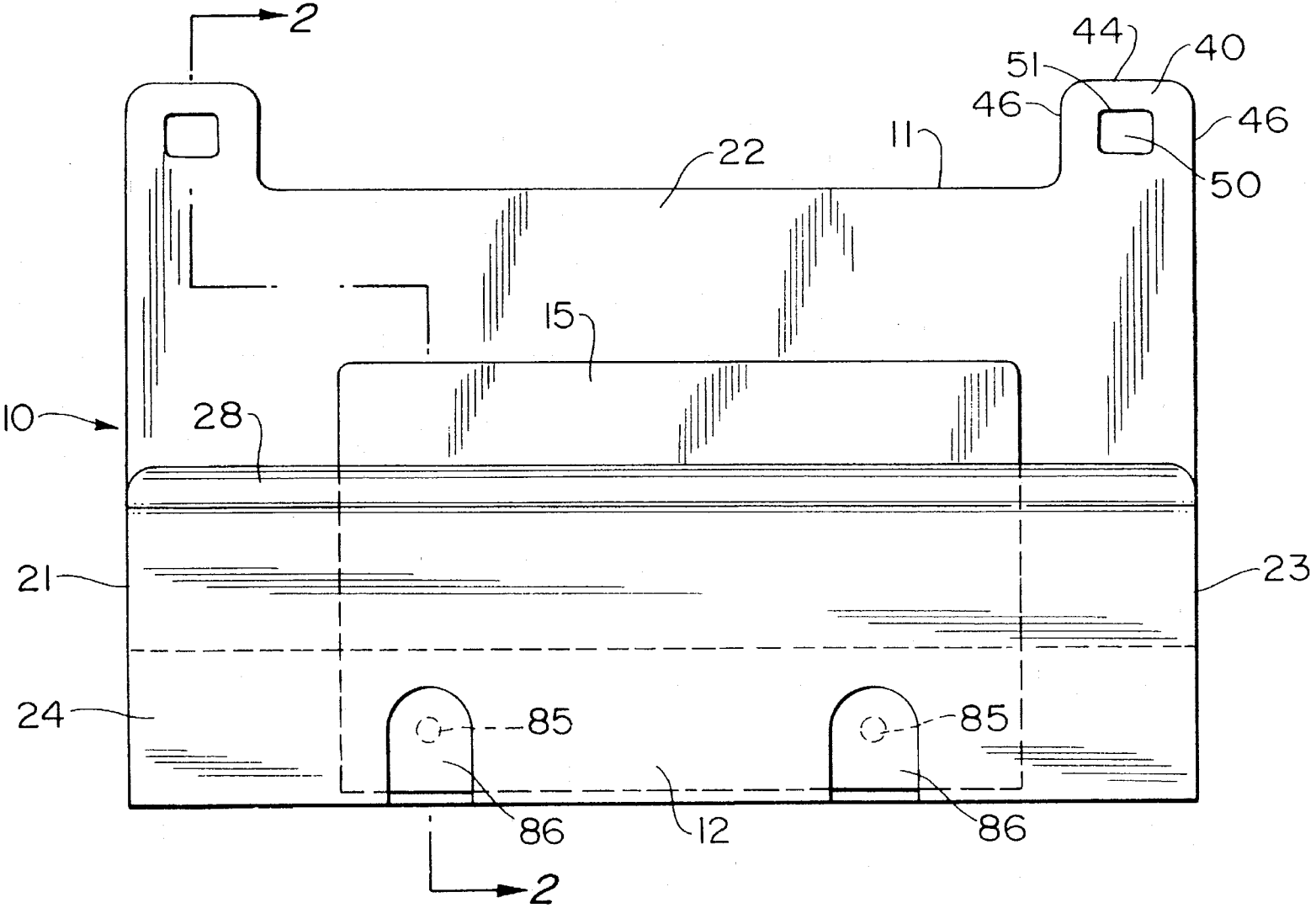
FIG. 1 is a front elevation of the flat article holder of the present invention.
Figure 2:
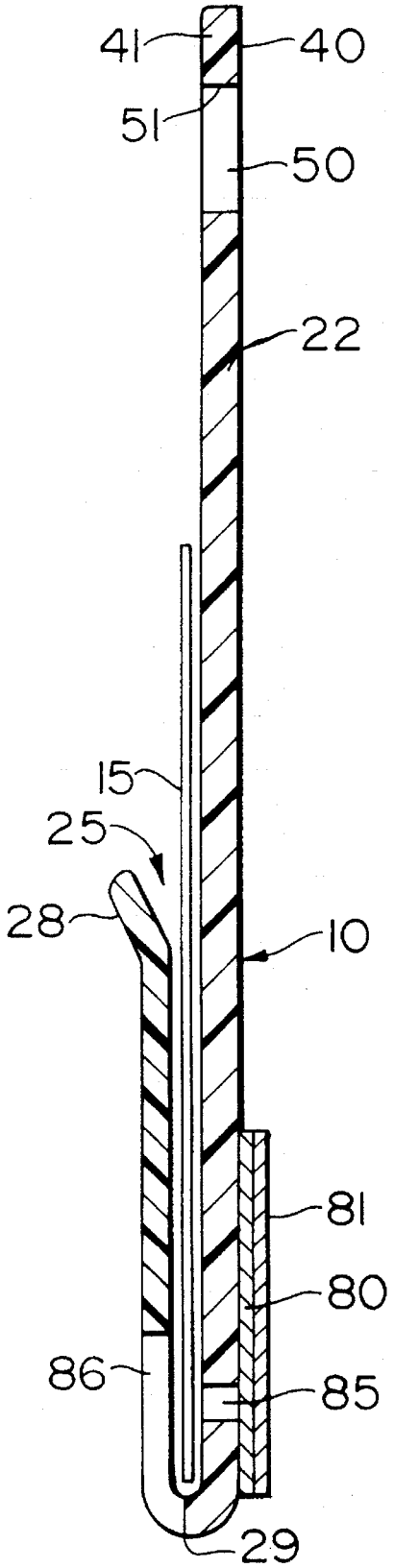
FIG. 2 is a cross sectional view of the article holder of FIG. 1 taken along line 2—2.

FIGS. 1 and 2 show a preferred embodiment of the article holder 10 of the present invention, which is shown holding a flat article 15, such as a card or a paper. The article holder is preferably made of a transparent plastic material having a planar back portion 22 and a front flap portion 24 that forms a pocket 25 in which article 15 is held. Of course, the article holder could also be made of a metal material such as sheet metal, but the remainder of the disclosure is directed to a plastic material embodiment. Along opposite side edges 21 and 23 of article holder 10, pocket 25 is open. To facilitate insertion of a card or paper article into pocket 25, the front flap portion 24 has a bevel top edge 28.

Preferably, pocket 25 is formed by heat deformation of a flat blank of transparent plastic material to make an approximately 180° fold 29 in the material, leaving flap 24, as shown in FIG. 2. However, alternative methods of forming pocket 25 are contemplated to be within the scope of the present invention and the pocket may be sealed or bonded together along side edges 21, 23 instead of having open side.

The present invention is directed to the mounting of article holder 10 for securing the holder to a substantially vertical support surface, such as a container wall. According to the preferred embodiment of the invention that is disclosed, the article holder is removably mounted on a side or end wall of the container for holding a card therein that displays identifying information about the container and/or contents therein.

Figure 3:
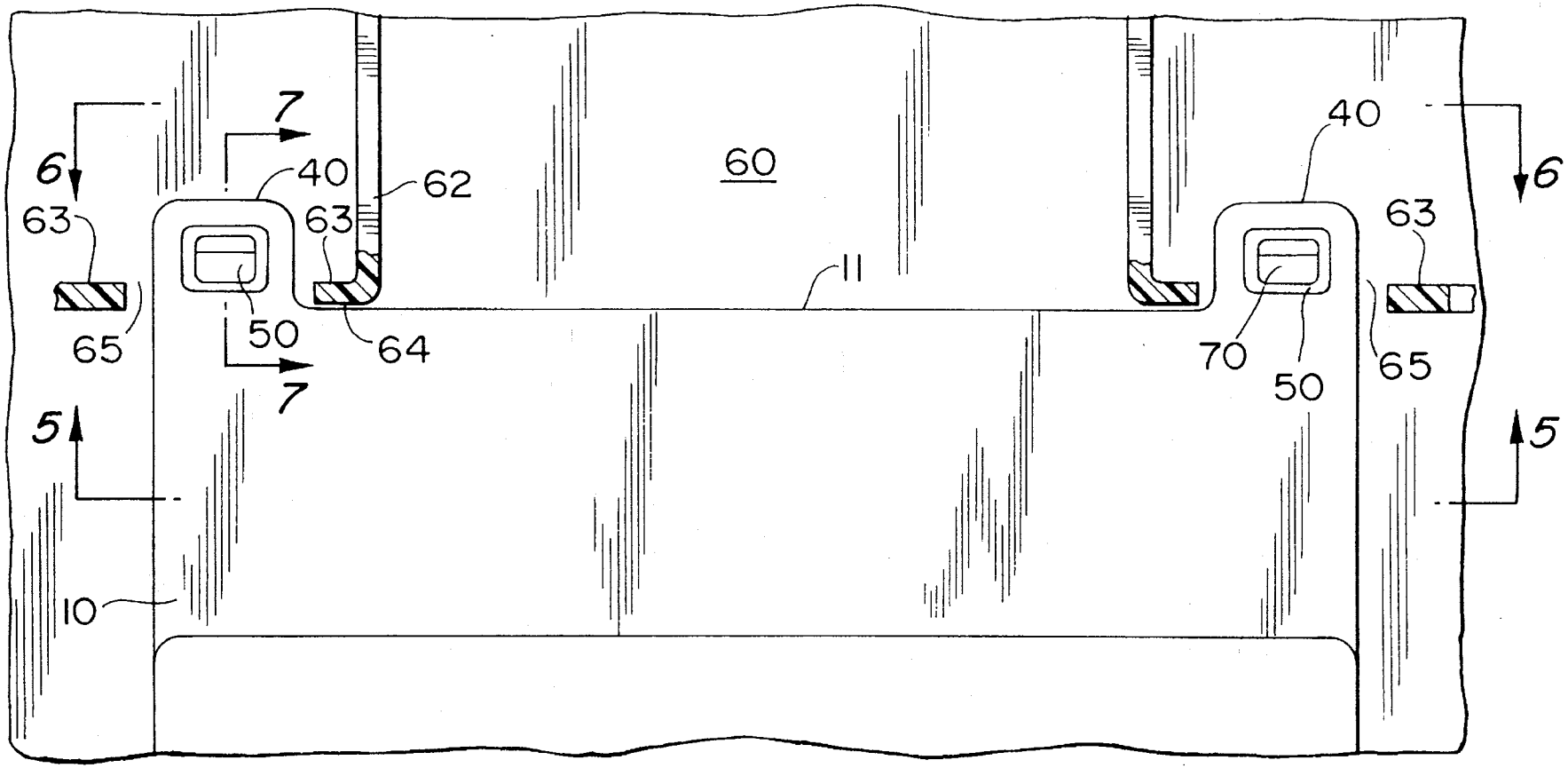
FIG. 3 is a front elevation of the card holder of FIG. 1 mounted on a container wall.
Figure 4:
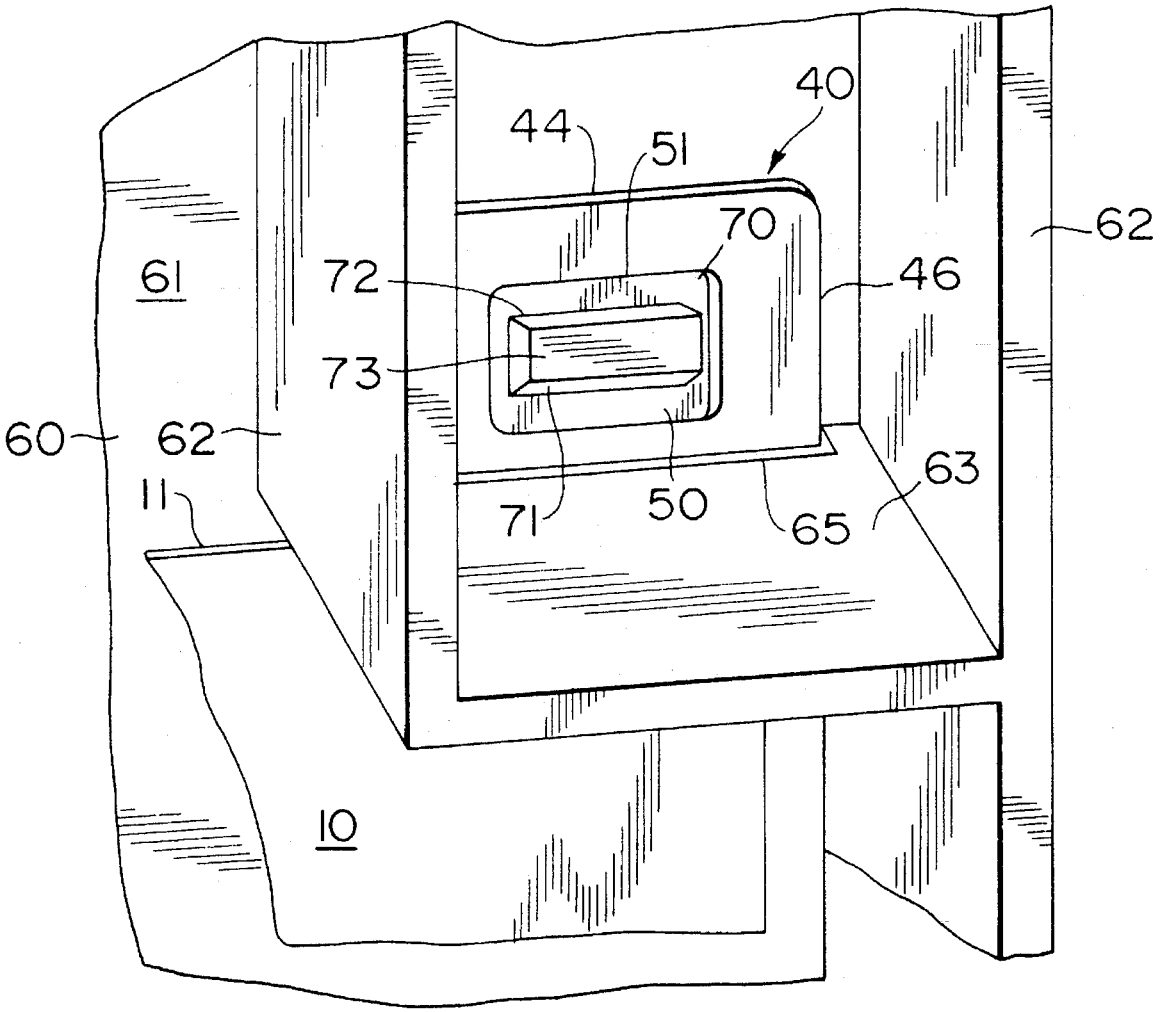
FIG. 4 is a perspective view of a portion of the card holder of FIG. 1 mounted on a container.

As shown in FIGS. 1–3, and in particular with respect to FIG. 4, article holder 10 has tab portions 40 at an upper end 11 of the holder. The tab portions 40 have top edges 44 and side edges 46. Between the side edges 46 is an aperture 50 having a top inner edge 51.

Figure 7:
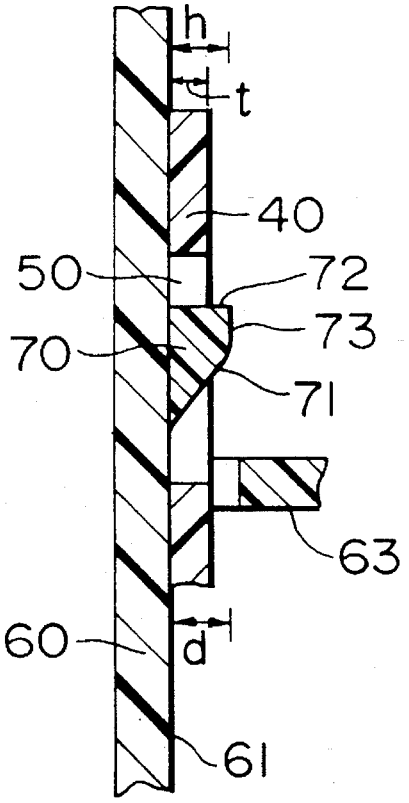
FIG. 7 is a sectional view of a portion of the card holder of FIG. 3 taken along line 7—7.
Figure 5:
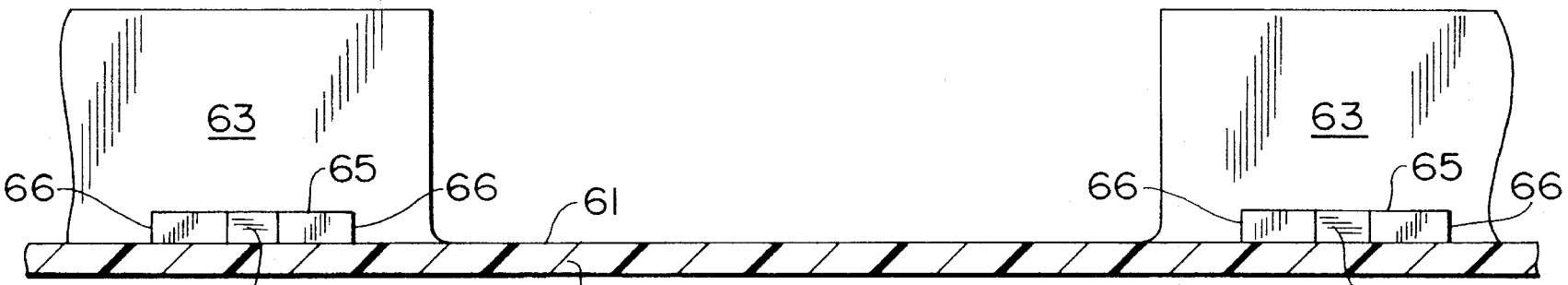
FIG. 5 is a view of the article holder taken along line 5—5 of FIG. 3.
Figure 6:
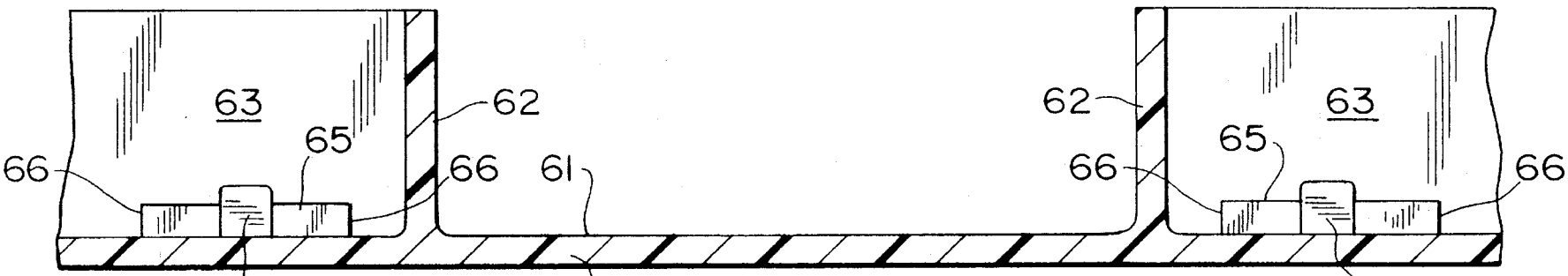
FIG. 6 is a view, partially in section, of a container wall taken along line 6—6 shown in FIG. 3 without the card holder shown, for clarity.

The article holder 10 is adapted to be mounted to a container 60 to lie flush against a substantially vertical wall 61 having vertically extending flange portions 62 and horizontally extending flanges 63, as shown in FIGS. 3 and 4. A slot 65 is formed in the horizontal flanges 63, as shown in FIGS. 5–7. The side edges 66 of slot 65 are spaced a sufficient distance apart to permit insertion of tab portions 40 of article holder 10.

Adjacent slots 65 are protrusions 70 formed in the wall 61 of container 60 having a ramp 71 that face the slot and a shoulder 72 opposite the opening of slot 65, which is preferably at right angles to the container wall, but which may be slightly tapered, particularly to provide any requisite mold relief. The protrusion extends outwardly from container wall 61 terminating in a top edge 73. The height h of protrusion 70 is preferably greater than that of the depth d of slot 65, but the height h may be equal to the depth d. The thickness t of the tab portions 40 is preferably about one half the depth d of slots 65 or more than.

To mount the article holder 10 in a simple and efficient manner to container 60, along wall 61 of the container, upper end 11 of the article holder is positioned to align tab portions 40 to be received within slot 65. When tab portions 40 are inserted into slots 65, top edges 44 of the tab portions are cammed upwardly by ramps 71 to deform the tab portions upwardly with respect to container wall 61 until top inner edge 51 of apertures 50 passes over top edge 73 of protrusion 70 whereupon protrusions 70 are received within apertures 50 with the top edges 51 of the apertures being engaged with shoulder 72 of the protrusions. In view of the relationship between the thickness t of the article holder, the depth d of slots 65 and the height h of protrusions 70, as set forth above, the tab portions 40 are secured in place so that the body portion 22 of the article holder lays flush against container wall 61.

In order to remove the article holder from container wall 61, it is only necessary to lift up the upper end portion 41 of tab portion 40 so that inner edge 51 of each aperture 50 is displaced to a point along upper edge 73 or ramp 71 of protrusions 70 thereby permitting withdrawal of the tab portions 40 from the slots 65.

According to the present invention, the slot 65 and protrusions 70 combination provided along container wall 61 of container 60 enables article holder 10, and in particular tab portions 40 thereof, to be quickly and efficiently guided into secure engagement and mounting of the article holder on the container wall. The resiliency inherent in the thin flat plastic construction of the body portion 22 and tab portions 40 of the article holder permit flexing of the tab portions up and over protrusions 70 as a result of providing ramp 71 that face the slots. This construction also permits the article holder 10 to be easily removed from the container wall 61 so that it may be reused or replaced as necessary.

According to the preferred embodiment of the invention, however, an adhesive strip 80 having a releasable strip 81 is provided so that after article holder 10 is secured in place with protrusions 70 received in apertures 50, the release strip 81 can be removed and the adhesive strip 80 pressed into contact with container wall 61. This creates a more permanent mounting of the article holder 10 to container wall 61, although the article holder can still be removed by breaking the bond between adhesive strip 80 and the article holder or container side wall 61.

According to a further modification, the article holder is provided with rivet holes 85 and aligned cut out portions 86 that permit a rivet to be passed through holes 85 and the container side wall 61 for securing bottom portion 12 of article holder 10. By riveting the bottom portion 12 of the holder to side wall 61, a more permanent installation of article holder 10 is accomplished. When such a permanent installation of article holder 10 is preferred.

As shown in the preferred embodiment, upper edge 51 of apertures 50 is spaced from upper edge portion 11 of body portion 22 of the article holder by a distance that is about equivalent to the distance between shoulder 72 of protrusions 70 and a surface 64 of horizontal flanges 63, which forms a stop, limiting the degree to which tab portion 40 can be inserted through slot 65. Of course, some tolerance is provided to allow upper end portions 41 of the tab portions 40 to be inserted sufficiently into slot 65 to permit top edge 51 of apertures 50 to snap over top edges 73 of protrusions 70.

I claim:

1. A holder and support surface in combination for removably securing a flat article to the support surface, comprising:

said holder having a retaining portion for holding a flat article and at least one tab portion having an aperture in said tab portion;

an upstanding structure extending upwardly from said support surface and having a slot for each said at least one tab portion through which said tab portion extends;

a protrusion that protrudes upwardly from the support surface adjacent the slot having a ramp that faces said slot;

said at least one tab portion having an edge spaced adjacent said aperture that engages said ramp to raise said at least one tab portion with respect to said support surface so that as said at least one tab portion passes through said slot said protrusion is received within said aperture.

2. The combination according to claim 1, including two of said at least one tab portions and two of said slots.

3. The combination according to claim 1, wherein said holder has a substantially planar body portion from which said at least one tab portion extends and a flap overlaying said body portion to form a pocket with open sides that receives a flat article.

4. The combination according to claim 3, wherein said flat portion is formed of a transparent plastic material.

5. The combination according to claim 1, wherein the support surface is a vertical wall of a container at each said slot and is formed in a horizontally extending flange such that a bottom wall of said slot is part of said vertical wall.

6. The combination according to claim 1, wherein the protrusion has a shoulder that engages the upper interior edge of the aperture.

7. The combination according to claim 1, wherein two tab portions are provided, each having an aperture and a support surface having two protrusions.

8. The combination according to claim 1, wherein the holder has a flap that receives flat card stock.

9. The combination according to claim 1, wherein the holder is transparent.

10. The combination according to claim 1, wherein the support surface is a vertical wall of a container and the slot is formed on a horizontally extending flange of a container.

11. The combination according to claim 1, wherein the holder has contact adhesive covered by a removable release strip for securing the holder to the support surface.

12. The combination according to claim 1, wherein the tab portion of the holder is sufficiently flexible to permit an interior edge of the aperture to be elastically deformed for releasing the edge from engagement with the shoulder portion and permitting the terminal edge to slide downwardly along the ramp when pulling the tab out of the slot.

13. A flat article holder mounted on a container, comprising:

said holder having a retaining portion for holding a flat article including two tab portions each having an aperture therein;

said container wall extending generally vertically and having a substantially horizontal upstanding flange extending outwardly therefrom, said flange having two slots, each said slot receiving one of said tab portions;

two protrusions extending outwardly from said container wall each having a ramp that faces a corresponding one of said slots, said tab portions each having an edge engaging corresponding ones of said ramps to raise the tab portions respectively with respect to said container walls so that said tab portions are pushed through said slots and said protrusions are received within said apertures, respectively.

* * * * *